US007597057B2

(12) United States Patent
Johnston et al.

(10) Patent No.: US 7,597,057 B2
(45) Date of Patent: Oct. 6, 2009

(54) REPLACEABLE LOOPER/HOOK MODULES

(75) Inventors: Kendall Johnston, Dalton, GA (US); Marshal Allen Neely, Soddy Daisy, TN (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 11/930,497

(22) Filed: Oct. 31, 2007

(65) Prior Publication Data

US 2008/0072808 A1 Mar. 27, 2008

Related U.S. Application Data

(63) Continuation-in-part of application No. 11/838,662, filed on Aug. 14, 2007, now Pat. No. 7,398,739, which is a continuation of application No. 11/668,920, filed on Jan. 30, 2007, now Pat. No. 7,284,492, which is a continuation of application No. 11/332,061, filed on Jan. 13, 2006, now Pat. No. 7,237,497.

(60) Provisional application No. 60/643,552, filed on Jan. 13, 2005.

(51) Int. Cl.
*D05C 15/22* (2006.01)
*D05C 15/00* (2006.01)

(52) U.S. Cl. ..... 112/80.45; 112/475.23

(58) Field of Classification Search ..... 112/80.01, 112/80.32, 80.4, 80.45–80.51, 80.6, 475.23
See application file for complete search history.

(56) References Cited

U.S. PATENT DOCUMENTS

| | | | |
|---|---|---|---|
| 2,213,552 | A | 9/1940 | Scharr |
| 2,562,939 | A | 7/1951 | Noe |
| 2,750,772 | A | 6/1956 | Bellini |
| 2,800,096 | A | 7/1957 | Signoret |
| 2,879,728 | A | 3/1959 | McCutchen |
| 2,889,791 | A | 6/1959 | Fedevich |
| 3,103,903 | A | 9/1963 | Broadrick et al. |
| 3,202,379 | A | 8/1965 | Dedmon et al. |
| 3,375,797 | A | 4/1968 | Gaines |
| 3,485,195 | A | 12/1969 | Torrence |
| 3,489,326 | A | 1/1970 | Singleton |
| 3,618,542 | A | 11/1971 | Zocher |
| 3,709,173 | A | 1/1973 | Greene |
| 3,757,709 | A | 9/1973 | Cobble |
| 3,835,797 | A | 9/1974 | Franks et al. |
| 3,847,098 | A | 11/1974 | Hammel, Jr. |
| 3,919,953 | A | 11/1975 | Card et al. |

(Continued)

FOREIGN PATENT DOCUMENTS

| | | |
|---|---|---|
| DE | 2503563 | 8/1976 |

(Continued)

*Primary Examiner*—Ismael Izaguirre
(74) *Attorney, Agent, or Firm*—Womble Carlyle Sandridge & Rice PLLC

(57) ABSTRACT

A hook/looper module assembly for a tufting machine is provided that allows for broken and damaged hooks of a level cut loop tufting machine to be replaced. The hook/looper module assembly includes modular blocks having a series of slots in which a series of hook or looper are received. Locking mechanisms secure the hook/looper within their respective slots in the modules and allows for removal of individual hook/looper from the module as needed for repair and replacement.

25 Claims, 5 Drawing Sheets

U.S. PATENT DOCUMENTS

| | | | | |
|---|---|---|---|---|
| 3,926,132 | A | | 12/1975 | Lear et al. |
| 4,111,646 | A | | 9/1978 | Buckwalter et al. |
| 4,134,348 | A | | 1/1979 | Scott |
| 4,138,956 | A | | 2/1979 | Parsons |
| 4,170,949 | A | | 10/1979 | Lund |
| 4,175,497 | A | | 11/1979 | Lund |
| 4,195,580 | A | | 4/1980 | Hurst |
| 4,217,837 | A | | 8/1980 | Beasley et al. |
| 4,303,024 | A | | 12/1981 | Bardsley |
| 4,313,388 | A | | 2/1982 | Slattery |
| 4,354,441 | A | * | 10/1982 | Hurst ..... 112/80.6 |
| 4,366,761 | A | | 1/1983 | Card |
| 4,440,102 | A | | 4/1984 | Card et al. |
| 4,448,137 | A | | 5/1984 | Curtis |
| 4,487,140 | A | | 12/1984 | Inman |
| 4,491,078 | A | | 1/1985 | Ingram |
| 4,562,781 | A | | 1/1986 | Green |
| 4,574,716 | A | | 3/1986 | Czelusniak, Jr. |
| 4,608,934 | A | | 9/1986 | Card et al. |
| 4,619,212 | A | | 10/1986 | Card et al. |
| 4,630,558 | A | | 12/1986 | Card et al. |
| 4,637,329 | A | | 1/1987 | Czelusniak, Jr. |
| 4,667,611 | A | | 5/1987 | Yamamoto et al. |
| 4,669,171 | A | | 6/1987 | Card et al. |
| 4,691,646 | A | | 9/1987 | Card et al. |
| 4,693,191 | A | | 9/1987 | Card et al. |
| 4,739,717 | A | | 4/1988 | Bardsley |
| 4,808,354 | A | * | 2/1989 | Nickols ..... 264/29.5 |
| 4,815,403 | A | | 3/1989 | Card et al. |
| 4,817,541 | A | | 4/1989 | Magourik |
| 4,822,241 | A | | 4/1989 | Jarvis et al. |
| 4,841,886 | A | | 6/1989 | Watkins |
| 4,856,441 | A | | 8/1989 | Kurata |
| 4,864,946 | A | | 9/1989 | Watkins |
| 4,903,624 | A | | 2/1990 | Card et al. |
| 4,903,625 | A | | 2/1990 | Card et al. |
| 5,058,518 | A | | 10/1991 | Card et al. |
| 5,094,178 | A | | 3/1992 | Watkins |
| 5,182,997 | A | | 2/1993 | Bardsley |
| 5,224,434 | A | | 7/1993 | Card et al. |
| 5,295,450 | A | | 3/1994 | Neely |
| 5,400,727 | A | | 3/1995 | Neely |
| 5,509,364 | A | | 4/1996 | Bardsley |
| 5,513,586 | A | | 5/1996 | Neely et al. |
| 5,544,605 | A | | 8/1996 | Frost |
| 5,575,228 | A | | 11/1996 | Padgett, III et al. |
| 5,622,126 | A | | 4/1997 | Card et al. |
| 5,743,201 | A | | 4/1998 | Card et al. |
| 5,896,821 | A | | 4/1999 | Neely et al. |
| 5,899,152 | A | | 5/1999 | Bardsley et al. |
| 5,954,003 | A | | 9/1999 | Beyer et al. |
| 5,983,815 | A | | 11/1999 | Card |
| 6,009,818 | A | | 1/2000 | Card et al. |
| 6,105,522 | A | | 8/2000 | Kato |
| 6,116,173 | A | | 9/2000 | Beyer |
| 6,155,187 | A | | 12/2000 | Bennett et al. |
| RE37,108 | E | | 3/2001 | Neely |
| 6,213,036 | B1 | | 4/2001 | Slattery |
| 6,244,203 | B1 | | 6/2001 | Morgante et al. |
| 6,260,493 | B1 | | 7/2001 | Dean |
| 6,263,811 | B1 | | 7/2001 | Crossley |
| 6,283,053 | B1 | | 9/2001 | Morgante et al. |
| 6,409,030 | B1 | | 6/2002 | Schlemper |
| 6,439,141 | B2 | | 8/2002 | Morgante et al. |
| 6,446,566 | B1 | | 9/2002 | Bennett et al. |
| 6,502,521 | B2 | | 1/2003 | Morgante et al. |
| 6,508,185 | B1 | | 1/2003 | Morgante et al. |
| 6,516,734 | B1 | | 2/2003 | Morgante et al. |
| 6,550,407 | B1 | | 4/2003 | Frost et al. |
| 6,672,230 | B2 | | 1/2004 | Green et al. |
| 6,675,729 | B2 | | 1/2004 | Green |
| 6,758,154 | B2 | | 7/2004 | Johnston |
| 6,807,917 | B1 | | 10/2004 | Christman et al. |
| 6,834,601 | B2 | | 12/2004 | Card |
| 7,007,617 | B2 | | 3/2006 | Johnston |
| 7,107,918 | B2 | | 9/2006 | Caylor et al. |
| 7,214,901 | B1 | | 5/2007 | Ball et al. |
| 7,237,497 | B2 | | 7/2007 | Johnston |
| 2004/0187268 | A1 | | 9/2004 | Johnston |
| 2006/0150882 | A1 | | 7/2006 | Johnston |
| 2006/0225630 | A1 | | 10/2006 | Kilgore |

FOREIGN PATENT DOCUMENTS

| | | | |
|---|---|---|---|
| EP | 1645 659 | A1 | 11/2004 |
| GB | 1 507 166 | | 5/1975 |
| GB | 2 002 040 | | 7/1978 |
| GB | 1541074 | | 2/1979 |
| GB | 2 266 537 | | 11/1996 |
| WO | WO 01/20069 | | 3/2001 |
| WO | WO 03/056091 | | 7/2003 |
| WO | WO 2005/054561 | | 6/2005 |
| WO | WO 2006/076558 | A1 | 7/2006 |
| WO | PCT/US2008/072453 | | 8/2008 |

* cited by examiner

REPLACEABLE LOOPER/HOOK MODULES

CROSS REFERENCE TO RELATED APPLICATIONS

The present application is a continuation-in-part of U.S. patent application Ser. No. 11/838,662, filed Aug. 14, 2007 now U.S. Pat. No. 7,398,739, which is a continuation of U.S. patent application Ser. No. 11/668,920, filed Jan. 30, 2007 now U.S. Pat. No. 7,284,492, which is a continuation of U.S. patent application Ser. No. 11/332,061, filed Jan. 13, 2006 now U.S. Pat. No. 7,237,497, and further claims priority to U.S. Provisional Application Ser. No. 60/643,552, filed Jan. 13, 2005.

FIELD OF THE INVENTION

The present invention generally relates to the design and assembly of gauge parts for tufting machines, and in particular to hook or looper modules for tufting machines to enable easy and efficient replacement of individual hooks or loopers in a tufting machine.

BACKGROUND OF THE INVENTION

During the operation of tufting machines, a series of needles mounted along a reciprocating needle bar and carrying a series of yarns penetrate a backing material and are engaged by a series of hooks or loopers for forming cut and loop pile tufts of yarn in the backing material. Such engagement requires close precision in the positioning and operation of the needles and the hooks or loopers to ensure efficient and accurate operation of the tufting machine. During assembly of the tufting machines, therefore, it is important that the needles, loopers, hooks, and/or other gauge parts be accurately mounted along their respective needle and/or hook or looper bars to ensure that such gauge parts are accurately and consistently spaced and positioned along their needle and hook or looper bars. If the gauge parts are misaligned, the individual gauge elements can become broken or damaged, and tufts of yarns can be mis-sewn, resulting in inaccurate or irregular patterns being formed, which carpets have to be discarded.

Accordingly, it has been common practice to assemble gauge parts such as loopers or hooks in modules, including cast modules in which the loopers or hooks are cast or mounted in a solid block or module, typically including five to ten, or more, individual gauge elements, precisely spaced in a series. These modules then are mounted on a hook bar or needle bar to help ensure substantially consistent and accurate spacing of the gauge parts. One problem that arises, however, is that typically with such cast modules, especially where such modules are used in smaller gauge (i.e., 10 gauge or less) tufting machines, if a single hook or looper fails, (such as becoming broken or dull), the whole hook or looper module must be replaced. Such replacement of the modules is expensive and can result in removal and replacement of several undamaged or fully functional hooks or loopers within each of the modules, which leads to potential waste of other hooks/loopers in the module that are still operable. This becomes even more of a problem with level cut loop (LCL) tufting machines, which typically further include a series of gates or clips that are selectively actuatable so as to move into an extended or retracted positions. Each hook generally will have a corresponding clip or gate that either opens to allow the hook to capture to yarn to form a cut pile tuft, or closes to prevent yarn capture, and thus urge the yarn off of the hook so as to form a loop pile tuft.

Accordingly, it can be seen that a need exists for a replaceable hook or looper module that addresses the foregoing and other related and unrelated problems in the art.

SUMMARY OF THE INVENTION

Briefly described, the present invention generally relates to a replaceable hook or looper module for use in tufting machines, typically for use in level cut loop ("LCL") type tufting machines, although the principles of the present invention also can be applied to other types of modules for use in various type and gauge tufting machines. The hook/looper module of the present invention generally will include a module body formed from machined or molded plastic, machined or cast metal, or other, similar high strength materials, and will include an upper portion or section having a series of spaced slots formed therein; an intermediate section; and a lower, vertically extending portion or section. A series of loopers or hooks generally will be received within the slots formed in the module body and will be retained therein for engaging and pulling loops of yarn from the needles of the tufting machine as the needles penetrate a backing material to form loop and cut pile tufts in the backing material. The module body further can include one or more locating devices, such as pins, tabs, projections or other similar mechanisms, along a rearwardly facing side of the module body.

Each of the hooks or loopers generally will include a body having a front end or bill that will engage a needle of the tufting machine as the needle penetrates the backing material, and a rear-section received within and extending along one of the slots formed through the module body. A slot or cavity generally can be formed in one side of the body of each looper or hook, with LCL clips or gates being slideably received within each such slot or cavity. Each clip generally has a first, proximal or forward end and is moveable along the forward section or bill of its associated looper or hook, and a rear or distal end that projects outwardly from the rear of the module body and is connected to a drive mechanism for reciprocating the clip through the module body. Each of the clips moves laterally through the module body as needed to permit loops of yarns to be captured and caught by the loopers or hooks or be urged off of the bill portions of each of the loopers or hooks so as to form cut or loop pile tufts as needed.

Each module body further generally includes a channel or passage extending through the intermediate or middle section thereof. One or more locking members will be received within this channel or passage, and can comprise a leaf spring, bar or similar biasing member that contacts or engages the lower edge of the body of each looper or hook. A series of fasteners can be inserted through the module body so as to engage and urge the one or more locking members against the lower edges of one or more of the loopers or hooks received within the module body to secure the loopers or hooks in the module body. Typically, there will be one fastener for each two loopers or hooks received within the module body, although a greater or lesser number of fasteners also can be used as needed or desired. If a looper or hook becomes broken, dull, or otherwise damaged, the fastener for that particular looper or hook can be removed so as to release the pressure and thus enable quick and easy removal and replacement of the looper or hook, rather than requiring replacement of the entire module.

Additionally, the module bodies can be formed by various processes including casting, machining, or other metal shaping operations. For example, the module bodies can be formed by an electrical discharge machining process in which the slots, locking member channel, fastener openings and other features are selectively formed in the module bodies without requiring cutting and/or removal of additional portions of the module bodies.

Various features, objects and advantages of the present invention will become apparent to those skilled in the art upon a review of the following detailed description, when taken in conjunction with the accompanying drawings.

DETAILED DESCRIPTION OF THE INVENTION

Figure 1:
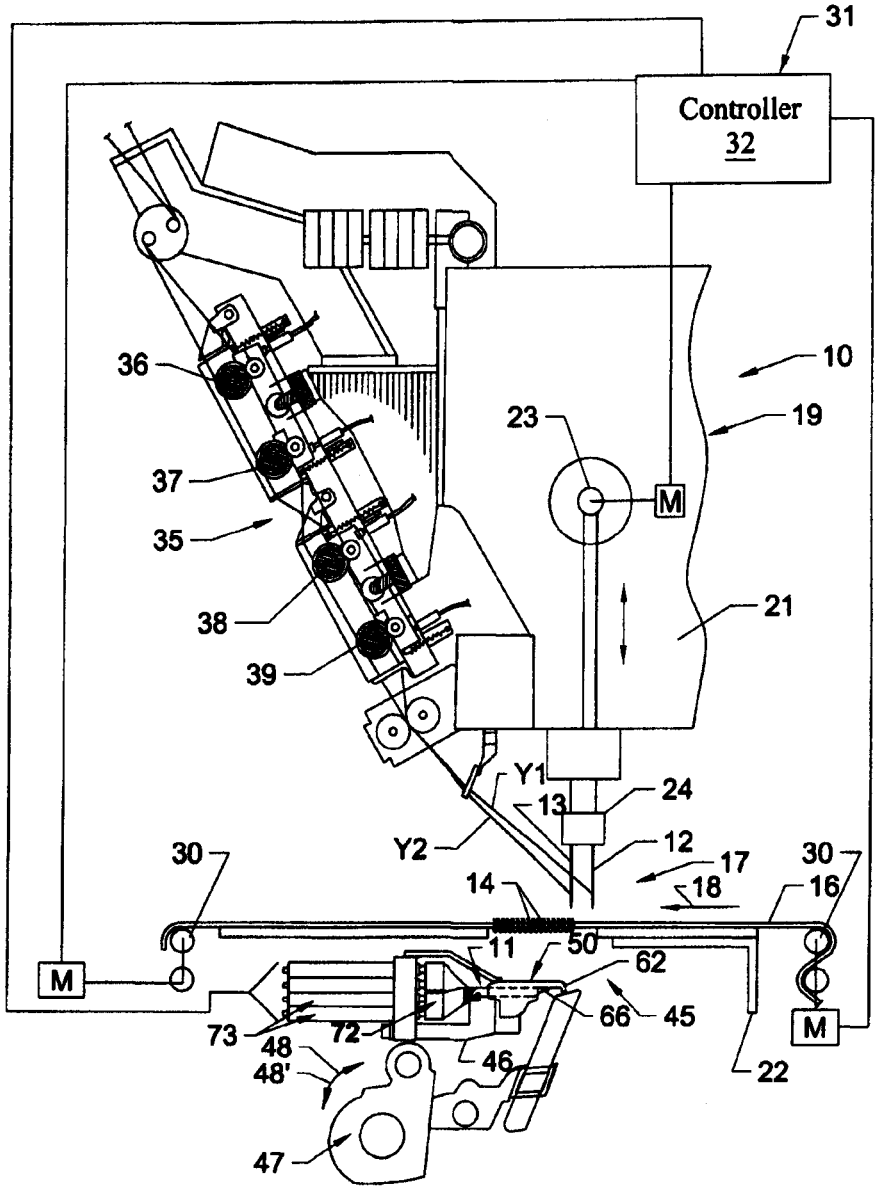
FIG. 1 is a side elevational view generally illustrating a tufting machine including the replaceable hook or looper modules of the present invention.

Referring now in greater detail to the drawings in which like numerals indicate like parts throughout the several views, FIG. 1 schematically illustrates a tufting machine 10 in which the replaceable looper or hook modules 11 of the present invention can be used. In the embodiment shown, the tufting machine 10 generally comprises a level cut loop ("LCL") type tufting machine for feeding a series of yarns, indicated by Y1 and Y2, to a series of needles, indicated by 12 and 13, for forming loop and cut pile tufts of yarns, generally illustrated at 14, in a backing material 16 as the backing material is moved through a tufting zone 17 in the direction of arrows 18, as indicated in FIG. 1. The tufting machine 10 further generally will include a frame 19 including an upper head portion 21, and a bed portion 22 over which the backing material 16 is passed. A main drive shaft 23 will drive one or more needle bars 24, which carry the spaced rows of needles 12 and 13 therealong. It will be understood that while a single needle bar with two rows of needles is shown, a single row of needles, a single shiftable needle bar, or a pair of shiftable needle bars also can be used, with the needles mounted in staggered rows therealong. It also will be understood that the present invention further can be used with other types of tufting machines in addition to LCL tufting machines.

As indicated in FIG. 1, the feed of the backing material 16 in the direction of arrows 18 generally will be controlled by a series of backing feed rolls 30 under the control of backing feed motors, indicated by M, controlled by the tufting machine control system 31, which generally will include a controller 32 that can be programmed with various pattern information and instructions. In addition, the yarns Y1 and Y2 generally will be fed from a yarn feed system 35 that typically includes a series of yarn feed rolls 36, 37, 38, 39. While only four yarn feed rolls are shown, it will be understood that additional yarn feed rolls also can be used, with the operation of the yarn feed system 35 generally being controlled by the tufting machine control system according to the pattern information within the controller 32. It further will be understood that various types of yarn feed mechanisms, including roll, scroll, single end or double end yarn feed attachments, such as Card-Monroe Corporation's Yarntronics™, Infinity™, and Infinity 2E™ pattern attachments, as well as various other yarn feed controls and/or pattern attachments, also can be used.

As indicated in FIG. 1, the replaceable hook/looper modules 11 of the present invention generally will be utilized as part of a cut pile hook or loop pile looper system or arrangement, including, in the example embodiment illustrated in the drawings, an LCL hook or looper arrangement or mechanism 45 mounted beneath the bed 22 of the tufting machine in a position so as to engage the needles 12 and 13 to pull loops of yarn therefrom to form the loop and cut pile tufts 14 in the backing material 16 as the needles penetrate the backing material. The LCL hook or looper mechanism 45 generally will include a hook bar 46 typically mounted on a reciprocating drive mechanism 47, with the replaceable hook/looper modules 11 of the present invention generally being mounted in spaced series therealong. The drive mechanism generally reciprocates or rocks the hook bar 46, and thus the replaceable hook/looper modules 11, in the direction of arrows 48 and 48' as the needles penetrate the backing material so as to move the loopers or hooks 50 of the replaceable hook/looper modules 11 into engagement with the needles 12 and 13. In addition, knives 49 generally are mounted on and reciprocated by the drive mechanism selectively into engagement with loops of yarn captured on the hooks or loopers 50 to form cut pile tufts.

Figure 2:
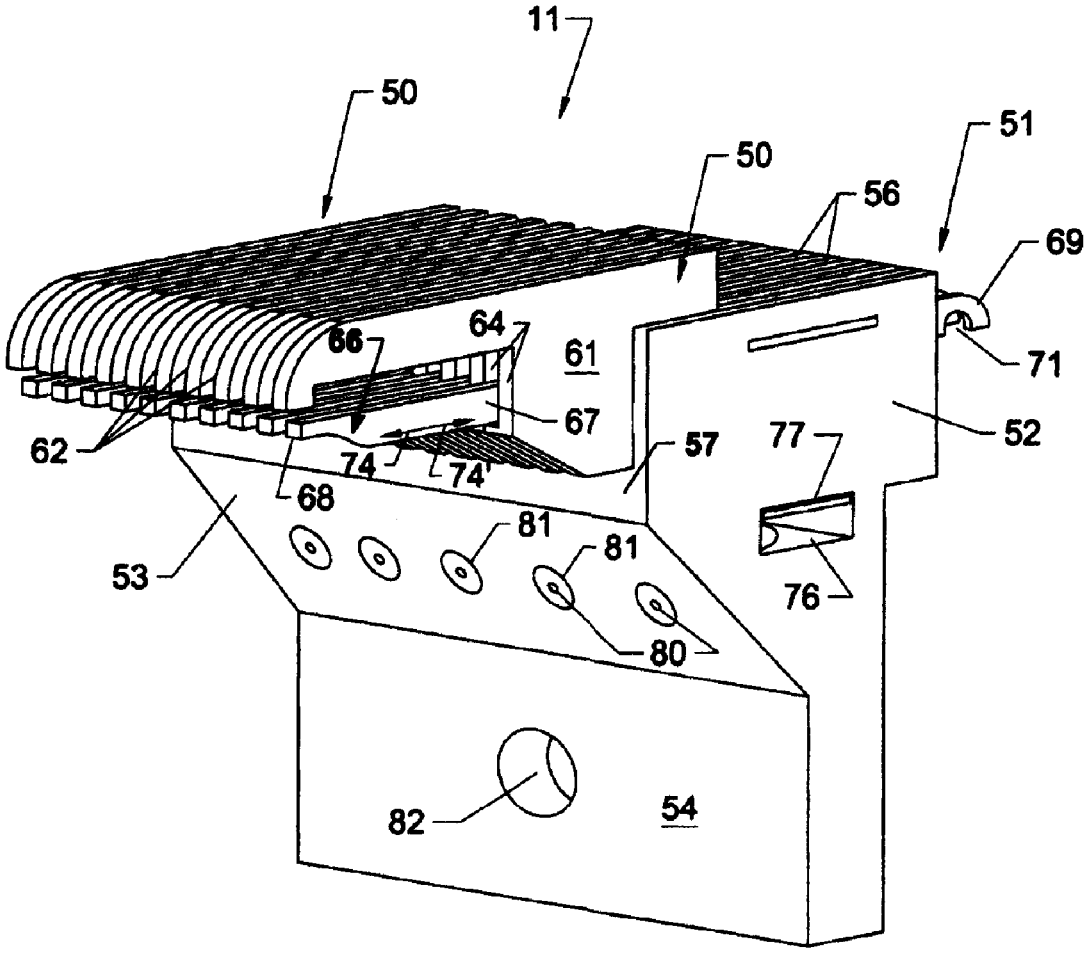
FIG. 2 is a perspective view of a hook or looper module according to the principles of the present invention.
Figure 3:
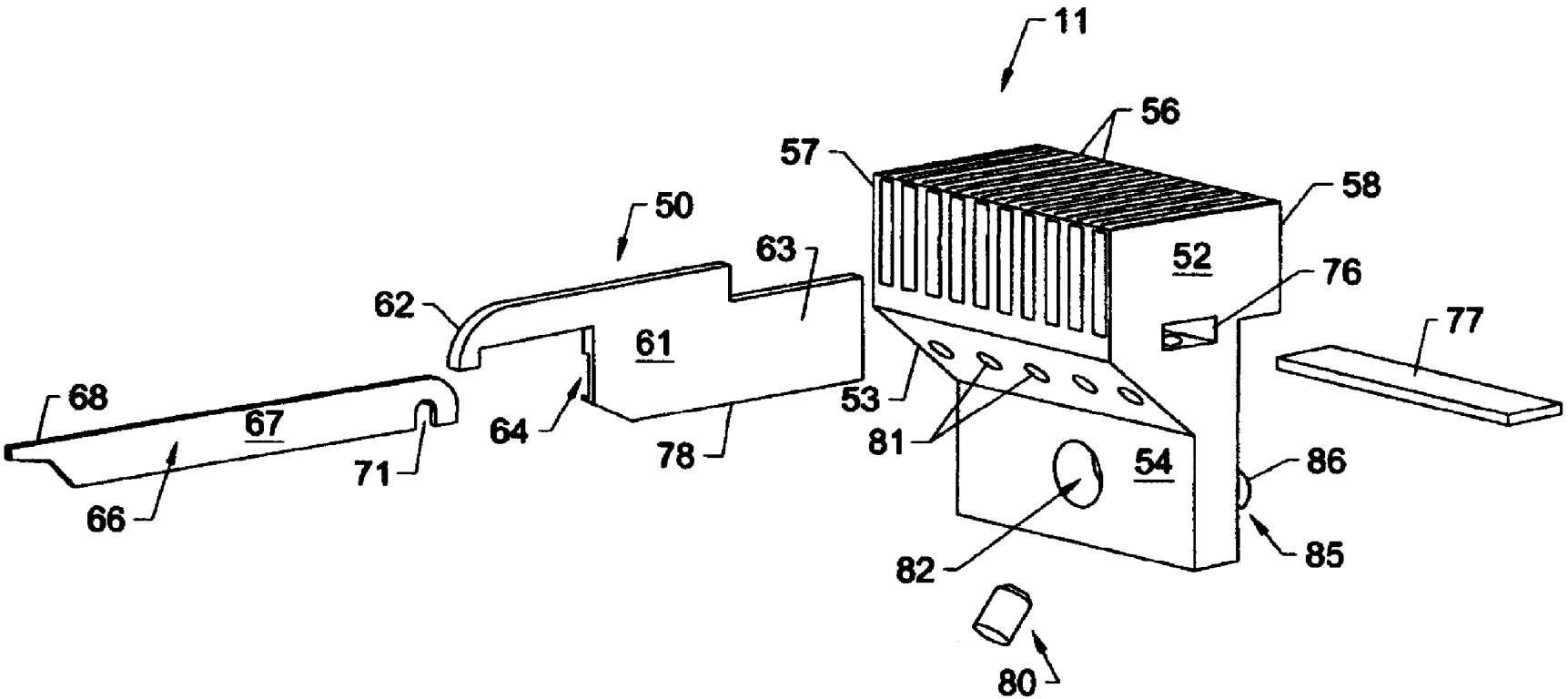
FIG. 3 is an exploded perspective view of the hook or looper module of FIG. 2.
Figure 4:
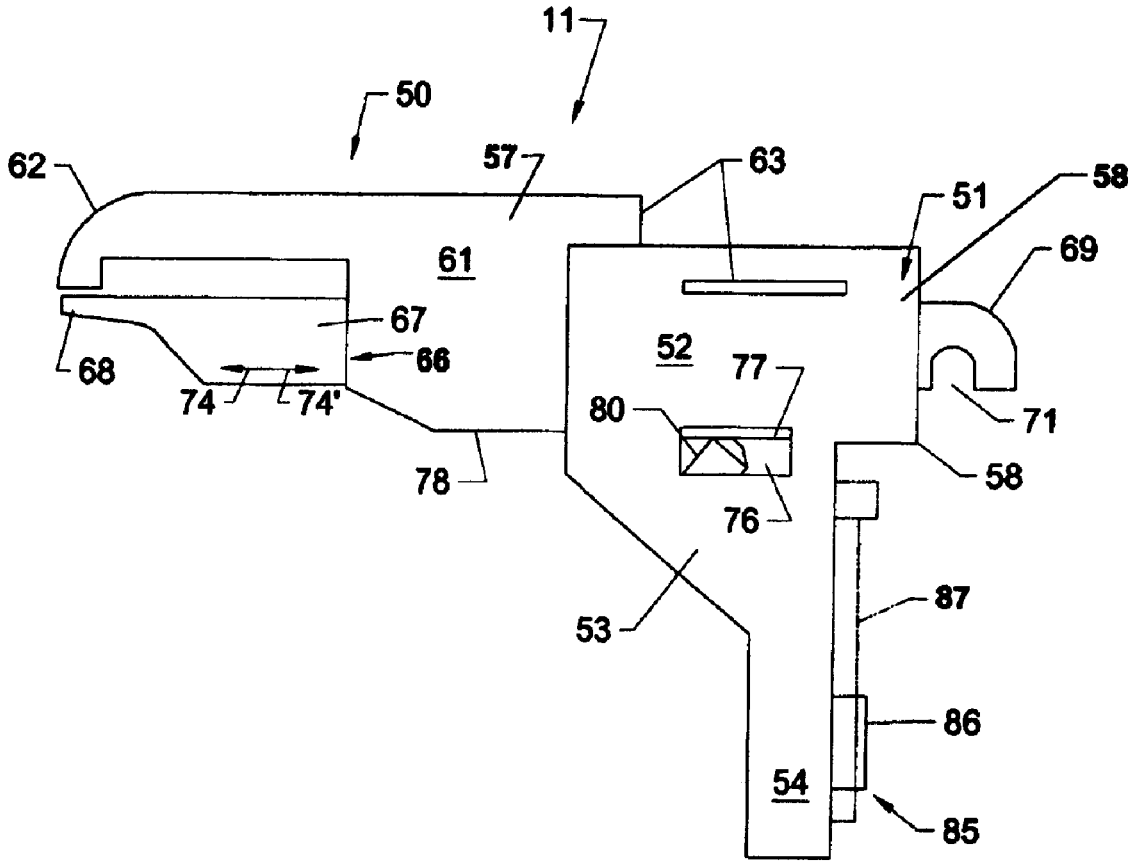
FIG. 4 is a side elevational view of a hook or looper module of the present invention as illustrated in FIG. 2.

As indicated in FIGS. 2-4, each of the replaceable hook/looper modules 11 of the present invention generally will include a module body or block 51 in which the loopers or hooks 50 are releasably mounted. Each module body or block 51 generally is formed from a rigid, durable, substantially high strength material. The module bodies further can be machined from or a cast as a block of a metal material such as steel, aluminum, or alloy materials, although it will also be understood by those skilled in the art that various other durable, high strength plastic or other synthetic materials also can be used, with the module bodies being injection molded, roto-molded, or otherwise formed from such plastic materials.

Each module body further generally will include a substantially rectangularly shaped upper section or portion 52, a tapering or sloped intermediate or middle section 53, and a vertically extending lower or bottom portion 54, which can have a reduced width or profile from the upper section 52. As indicated in FIGS. 2 and 3, the upper section 52 generally will have a top side or surface 55 and a series of slots or channels 56 extending laterally through the upper section 52 from a front face 57 of the module body toward a rear face 58 of the module body 51. Each of the hooks 50 generally will be received within and slid along the slots to a seated position in order to mount the hooks in a predetermined spaced series within each module body.

Figure 5A:
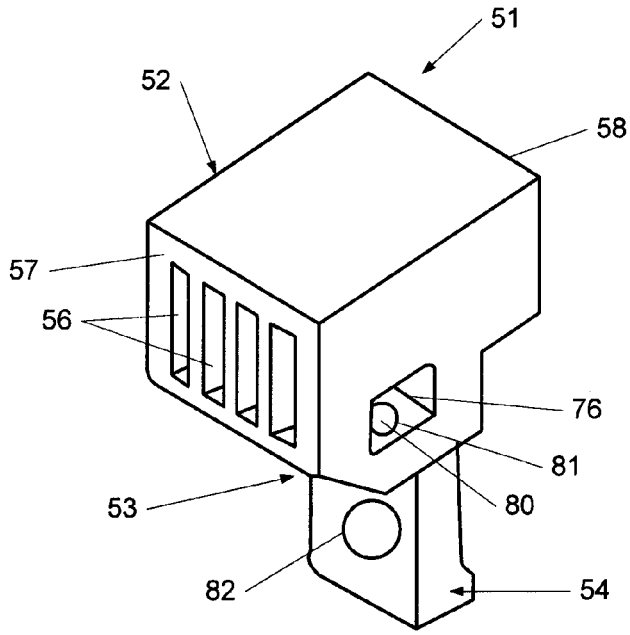
FIG. 5A is a perspective view of another embodiment of a hook or looper module according to the present invention.
Figure 5B:
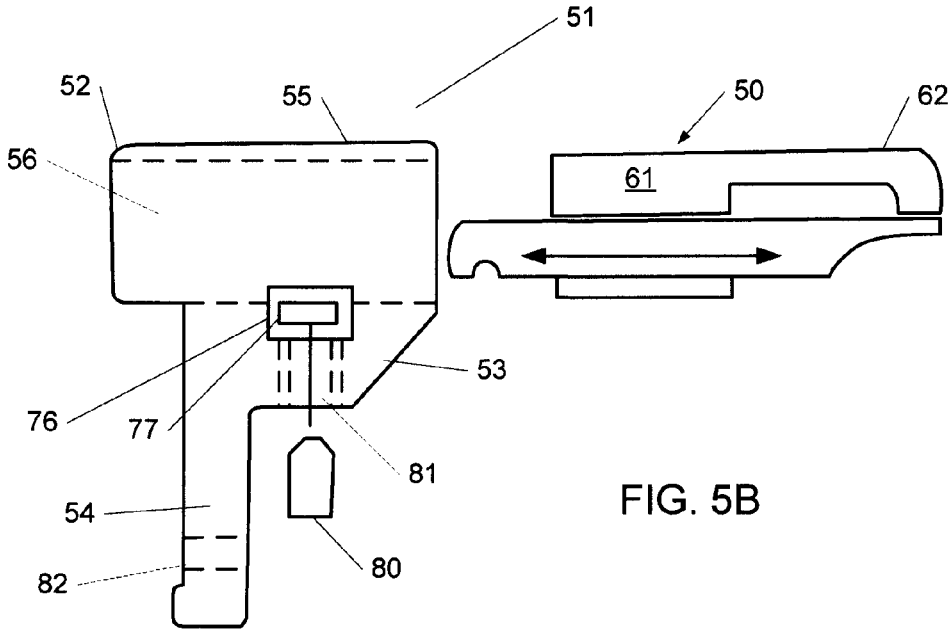
FIG. 5B is a side elevational view of the hook or looper module of FIG. 5A.

Alternatively, the module bodies 51 (FIGS. 5A-5B) can be formed from blocks or pieces of pre-hardened metal materials utilizing an electrical discharge machining (EDM) process. in such a process, the slots 56 can be formed through the upper portion 52 of each module body 51 by application of recurring electrical arcing discharges applied to the module body from an electrode or EDM cutting tool. The electrical arcing discharges cause the metal of the module body to be melted and/or vaporized or cut away as the EDM cutting tool is directed along a cutting path so as to form the slots 56, channels 76, and fastener openings 81 through the upper portion 52 of each module body as indicated in FIGS. 5A-5B. As a result, the slots 56, channel 76, and fastener openings 81 of each module can be precisely formed therein without requiring cutting and removal of excess material from the module bodies, such as formation of the slots 56 through the top surface 55 of the upper portion 52 as shown in FIGS. 2-3. Such a construction/formation of the module bodies as shown in FIGS. 5A-5B further helps reduce collection of dust and debris within the slots 56, which thereafter must be removed or cleaned from the slots before replacement of the hooks or loopers 50 therein.

Typically, there can be approximately five to ten loopers or hooks 50 received and releasably mounted within each module body 51. It will, however, be understood by those skilled in the art that lesser or fewer numbers or hooks or loopers 50 also can be used in the module bodies of the replaceable hook modules formed according to the principles of the present invention. As indicated in FIGS. 2-4, each of the hooks or loopers 50 generally is formed from a rigid, durable material, such as being stamped from steel or other, similar material. Each looper or hook also generally includes an elongated body 61 having a hooked front or bill portion 62 projecting forwardly therefrom, and a rear portion or tail section 63 extending in an opposite direction from the front portion 62. The rear portion 63 of each looper or hook 50 generally will be received within one of the slots or channels 56 formed within the module body 51, as indicated in FIGS. 2 and 3 during mounting of the hooks or loopers in the module body. A channel or recess 64 further generally will be formed along one side surface of the body 61 of each looper or hook 50, extending rearwardly along the length of the body.

As indicated in FIGS. 2 and 4, an LCL clip or gate 66 generally will be slideably received within the slot 64 of each hook 50. Each of the clips 66 will include an elongated body 67, generally formed from materials such as a plastic or other, similar substantially rigid, durable material, and will have a pointed first or forward end 68 and a rear end 69 extending longitudinally through the module body 51 and along the slot 64 of its associated looper or hook 50. The rearward end 69 of each clip generally will project outwardly from the rear surface 58 of the module body 51. Each clip is generally engaged by a connector 72 (FIG. 1) of the LCL hook or looper mechanism 45 for the tufting machine 10, which connectors 72 further generally are attached to an actuator such as a cylinder 73. The firing of the cylinders 73 is controlled by the controller 32 of the tufting machine control system 31 so as to selectively actuate or engage each cylinder and thus cause the clips 66 to be selectively extended and retracted in the direction of arrows 74 and 74', as indicated in FIGS. 2 and 4, to selectively engage and urge loops of yarn off the front or bill portions 62 of each of their loopers or hooks as needed to form the loop and cut pile tufts of yarns in the backing material.

As indicated in FIGS. 2 and 3, a longitudinally extending passage or channel 76 generally is formed through each module body 51. Each channel 76 generally receives a locking member 77 therein. Each locking member 77 can include a leaf spring, bar, or other similar biasing or locking member, and can be formed from a metal or plastic material, or can otherwise include a substantially flat piece of a resilient material that will be received and bear against a bottom or lower side surface 78 (FIG. 3) of each looper or hook 50. As indicated in FIGS. 2 and 3, fasteners 80 are received within a series of fastener openings or recesses 81 formed in the intermediate or middle section 53 of each module body 51. Each of the fasteners 80 can include a set screw, detent, or other, similar type or removable fastener and will be received through its fastener opening 81. The fasteners move into engagement with the locking member 77 as they are moved along their recesses so as to force or urge a portion of the locking member 77 upwardly into engagement with the bottom surfaces 78 of one or more of the loopers or hooks 50. Typically, there will be approximately one set screw for each two or three loopers or hooks, although greater or fewer fasteners, i.e., one fastener for each three or four loopers or hooks, also can be provided.

As further illustrated in FIGS. 2 and 3, a module detent or fastener opening 82 can be formed through the lower section 54 of each module body, and adapted to receive a fastener, such as a detent, set screw or other similar fastener, therethrough to mount the module body on the hook bar. Locating devices such as one or more pins 86 (FIGS. 3 and 4), tabs (shown by phantom line 87 in FIG. 4), or other similar projections or protrusions formed with or mounted to the rear side surface 58 of each module body 51, also can be provided to assist in locating and mounting the replaceable hook/looper modules 11 of the present invention in a desired position or orientation along the hook or gauge bar of the tufting machine.

In use of the replaceable looper/hook module of the present invention, should one or more loopers or hooks 50 become damaged during operation, such as becoming worn, broken, or bent, instead of having to replace the entire module of five to ten or more loopers or hooks, the fastener or fasteners 80 for each of the loopers or hooks that have become damaged can simply be removed and the hooks slid from their receiving slot 56, with their respective LCL clips likewise sliding along the recess 64 formed therein, to enable replacement of the individual, damaged looper or hook. A replacement looper or hook then simply can be inserted into the receiving slot 56 with the associated LCL clip being received in and sliding along the slot of recess 64 formed in the looper or hook. Thereafter, the fastener(s) 80 associated with the replaced looper(s) or hook(s) will be replaced to lock the new replacement looper or hook within the module body.

The present invention thus enables each hook or looper to be installed and removed individually in a looper or hook module for use in a tufting machine such as an LCL type tufting machine, without requiring the hooks or loopers to be permanently molded or fixed within the module body. Instead individual loopers or hooks can be set within a register at a predetermined spacing and will be releasably held in place to enable quick and easy individual replacement without requiring replacement of the entire hook module to fix one or two broken loopers or hooks.

It will be understood by those skilled in the art that while the present invention has been discussed above with reference to particular embodiments, various modifications, additions and changes can be made to the present invention without departing from the spirit and scope of the present invention.

What is claimed:

1. A module for use in a hook or looper assembly for a tufting machine, comprising:

a module body formed with a series of slots extending therethrough from a front face to a rear face of said module body;

a plurality of individual hooks or loopers, each including a base received in one of said slots formed in said module body, and a forwardly projecting end;

a series of fasteners removeably engaging said module body, each of said fasteners extended through said module body so as to hold at least one hook or looper within said module body;

wherein there are more hooks or loopers than fasteners, and each of said hooks or loopers is individually removeable from one of said slots of said module body upon disengagement of a fastener that is in engagement therewith, and wherein said slots of said module body are formed through said module body as open ended passages enclosed on four sides thereof by electrical discharge machining, without requiring cutting of a top surface of said module body.

2. The module of claim 1 and further comprising a locking member urged into biasing engagement against at least one of said hooks or loopers.

3. The module of claim 2 and wherein said locking member comprises a spring that engages and bears against a portion of a pair of hooks or loopers.

4. The module of claim 1 and further comprising a locking member, wherein each fastener urges said locking member into engagement with at least two adjacent hooks or loopers.

5. The module of claim 1 and wherein said fasteners each comprise a set screw and wherein there is at least one set screw for each two hooks or loopers.

6. The module of claim 1 and wherein said module body further comprises a locator along a side surface of said module body and adapted to engage a hook or looper bar for mounting said module body therealong.

7. The module of claim 1 and wherein said hooks or loopers comprise cut pile hooks.

8. The module of claim 1 and wherein said hooks or loopers comprise loop pile loopers.

9. The module of claim 1 and wherein said hooks or loopers comprise level cut loop hooks.

10. A tufting machine comprising:

a frame;

at least one reciprocating needle bar having a plurality of needles arranged in spaced series therealong, said needles carrying a series of yarns for forming cut or loop pile tufts in a backing material passing through the tufting machine;

a hook or looper assembly mounted below said needle bar and comprising:

a series of modules each having a plurality of substantially non-cylindrically shared slots having a series of sides and being formed by electrical discharge machining such that said slots are substantially enclosed along the sides thereof and extend from a front face through each of said modules;

a plurality of loopers each removeably received within one of said slots of said modules and adapted to engage said needles of said needle bar; and a series of fasteners received within each of said modules and each releasably engaging a portion of at least one of said loopers to secure said loopers within said modules, wherein there are at least approximately half as many fasteners as there are loopers.

11. The tufting machine of claim 10 and further comprising at least one locking member engaged by said fasteners to provide a bearing force against at least one of said level cut loopers to secure said level cut loopers in said modules.

12. The tufting machine of claim 11 and wherein said at least one locking member comprises a spring.

13. The tufting machine of claim 10 and wherein said module body further comprises a locator along a side surface of said module body adapted to engage a hook bar.

14. The tufting machine of claim 13 and wherein said locator comprises a tab projecting from said side surface of said module body.

15. The tufting machine of claim 13 and wherein said locator comprises at least one pin projecting from said side surface of said module body.

16. The tufting machine of claim 10 and wherein said loopers comprise level cut loop hooks and wherein said looper assembly further comprises a series of clips moveable between retraced and extended positions adjacent said level cut loop hooks for controlling formation of loop and cut pile tufts of yarns.

17. The tufting machine of claim 10 and wherein said loopers comprise loop pile loopers.

18. The tufting machine of claim 10 and wherein said loopers comprise cut pile hooks.

19. The tufting machine of claim 10 and further comprising a backing feed roll for feeding the backing material through the tufting machine.

20. A method of assembling a tufting machine, comprising:

forming a series of hook or looper modules with an electrical discharge machining tool, including applying electrical discharge arcing to each hook or looper module to form a series of slots of a desired configuration through a portion of each hook or looper module, each slot being enclosed along at least four sides thereof and extending from a front face toward a rear face thereof, and at least one fastener opening;

releasably mounting a series of hooks or loopers within each of the slots of the hook or looper modules;

mounting the hook or looper modules in spaced series beneath a tufting zone of the tufting machine; and providing at least one needle bar having a plurality of needles mounted in spaced series therealong.

21. The method of claim 20 and wherein releasably mounting a series of hooks or loopers within the slots comprises inserting a hook or loopers within each slot and inserting a series of fasteners into each module into bearing engagement with the hooks or loopers.

22. The method of claim 21 and wherein inserting a series of fasteners comprises inserting fewer fasteners than hooks or loopers.

23. The method of claim 21 and further comprising inserting a locking member into each module between the fasteners and the hooks or loopers and urging the locking member against the hooks or loopers with the fasteners to secure the hooks or loopers within the slots of the modules.

24. The method of claim 20 and further comprising locating the hook or looper modules in a desired alignment along a gauge bar beneath the tufting zone of the tufting machine.

25. The method of claim 20 and wherein the slots are formed with a substantially non-cylindrical configuration.

* * * * *